United States Patent [19]

Lavenius et al.

[11] Patent Number: 5,048,290

[45] Date of Patent: Sep. 17, 1991

[54] ARRANGEMENT FOR WASTE GAS PURIFICATION

[75] Inventors: Mats R. F. Lavenius, Göteborg; Karl F. Wildt-Persson, Askim; George N. Fraquhar, Alingsås, all of Sweden

[73] Assignee: Aktiebolaget Electrolux, Stockholm, Sweden

[21] Appl. No.: 528,699

[22] Filed: May 24, 1990

[30] Foreign Application Priority Data

May 29, 1989 [SE] Sweden ..... 8901908

[51] Int. Cl.[5] ..... F01N 3/28

[52] U.S. Cl. ..... 60/299; 60/302; 181/240; 422/173; 422/176; 422/177

[58] Field of Search ..... 60/299, 302; 181/240; 422/173, 176, 177

[56] References Cited

U.S. PATENT DOCUMENTS 4,091,616 5/1978 Loweg ..... 60/299

4,426,844 1/1984 Nakano ..... 60/299

4,867,270 9/1989 Wissman ..... 60/302

4,890,690 1/1990 Fischer ..... 60/299

*Primary Examiner*—Douglas Hart

*Attorney, Agent, or Firm*—Pearne, Gordon, McCoy & Granger

[57] ABSTRACT

A catalyst according to the invention with its cooling package is an easily exchangeable unit that is plugged into an existing silencing device. The catalyst (29) is integrated with a perforated radiation protection and distribution plate (26) in front of it and furthermore with another plate behind it functioning as a lid (24) and fastening member against a silencer. Outside the lid there is a cooler attached which removes the heat. A waste gas outlet (32) takes place via a waste gas tube (23) to the rear corner of the silencer, where fan air, used for engine cooling, passes by. The waste gases get mixed to the fan air and the temperature will be reduced to an acceptable level.

4 Claims, 1 Drawing Sheet

ARRANGEMENT FOR WASTE GAS PURIFICATION

The present invention relates to an arrangement for purification of waste gases from small combustion engines, e.g. chain saw engines.

It is known to join a catalyst and a silencer in one unit when it comes to small engines, where the space is limited. By doing so the size or the weight of the machine will not increase to a degree worth mentioning. It has been ascertained, however, that the high temperature in respect of catalyst purification causes problems in a small machine carried by the operator when working. On one hand, the silencer wall is very hot and on the other hand the waste gases from the purifier are very hot. The waste gas temperature from the engine, is, when working, about 600° C. and the catalyst increases the temperature by further some 400° C. which involves a gas temperature after purification of about 1000° C. In order to avoid burns or ignition the gas temperature must prior to its outlet from the unit be cooled and cooling must take place in several steps. Furthermore, the life and the function of the catalyst are negatively influenced by too high temperatures. Temperatures more than 850° C. should be avoided as much as possible. The unit should also have such properties that the stored heat capacity is—when the engine has stopped—conducted ahead (from the engine) where the ambient air through self-circulation can, in an efficient way, contribute to cooling the engine and in this way prevent it from getting extra so-called after-heat. This has been realized by the invention thanks to a welded replaceable unit in the silencer consisting of a catalyst, a casing, a lid and a cooler on the lid. Moreover, an outlet from the unit is arranged so that fan air from the engine cooling is mixed with the waste gases. An arrangement according to this idea shall have the properties stated in the characteristics of claim 1.

Figure 1:
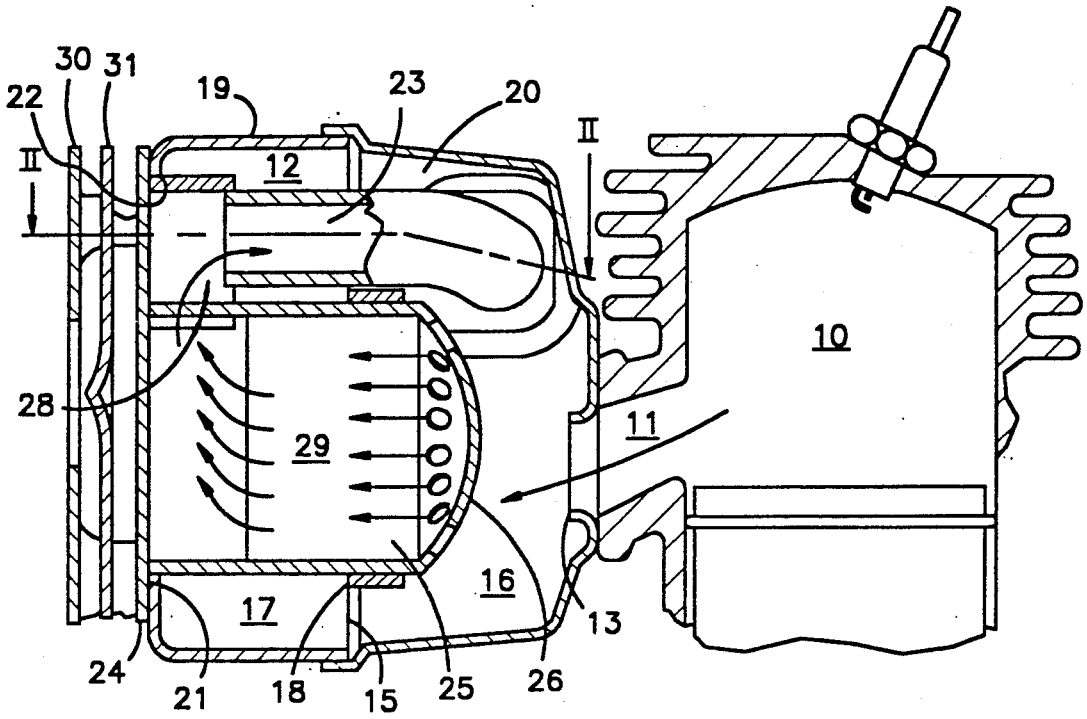

An embodiment of the arrangment according to the invention is described in the following with reference to the attached drawing showing in FIG. 1 a vertical cross section of the silencer with a catalyst connected to an engine, FIG. 2 a horizontal cross section of the silencer with a catalyst.

In the embodiment on the drawing the cylinder of a two-stroke engine 10 is shown having a waste gas flow 11 conducting to a combined silencer/catalyst 12. That one has a port 13 between a couple of screws 14 holding it against the cylinder. A partition wall 15 divides the inner of the silencer in two chambers 16, 17 which are connected through a hole 18 in the wall, and are enclosed in a couple of sheet steel shells 19, 20 being combined to one unit. The plane wall 21 of the sheet steel shell 19 has an opening 22 which is concentric to the hole 18 in the partition wall 15. Through this hole it is possible to reach the screws 14 by means of a screw tool and in this way fasten the unit to the cylinder. Across the chamber 17 an outlet tube 23 passes through the partition wall 15 in a bend out of the sheet steel shell 20 to the surroundings.

The plane wall 21 with the opening 22 is covered by a lid 24 which is closely fixed to the wall by means of screws. On the inside of the lid a sheet steel cylinder 25 is attached and carried through the opening 22 and the hole 18. The end of the cylinder is covered by a curved plate 26 having through passage holes 27. An opening in the wall of the cylinder opens out into a collecting chamber 28 and the outlet tube 23. In this way a gas way is opened according to the arrows in FIG. 1 from the channel 11 through the port 13, the holes 27, the chamber 28 and the tube 23 to the surroundings.

A catalytic element 29 is included in the sheet steel cylinder 25 and covers the entire cross section of it so that the gases must pass through the element. The holes in the plate 26 have the function of distributing the gas flow all over the cross section of the element so that all parts of it take part in the process. This gives a homogeneous temperature in the element and the best possible processing of the waste gases. The plate 26 is convex towards the engine and therefore provides a diverging radiation against it which causes less heat transmission to the engine from the element, when the engine has stopped.

The lid 24 is very temperature-loaded and has therefore been provided with a cooling package of plates 30, 31 being attached to the screws as well. The plates also serve as a touch protection shield in front of the very hot lid 24.

The catalytic element with the lid and cooling package is easy to exchange as it is of a plug-in type with a simple fastening to the silencer shell. Such a plug-in unit can be built into the already existing silencers which have steel metal shells similar to those described here. A further advantage with the plug-in system is the possibility of dismounting the silencer, clean it and replace burned-out parts.

Figure 2:
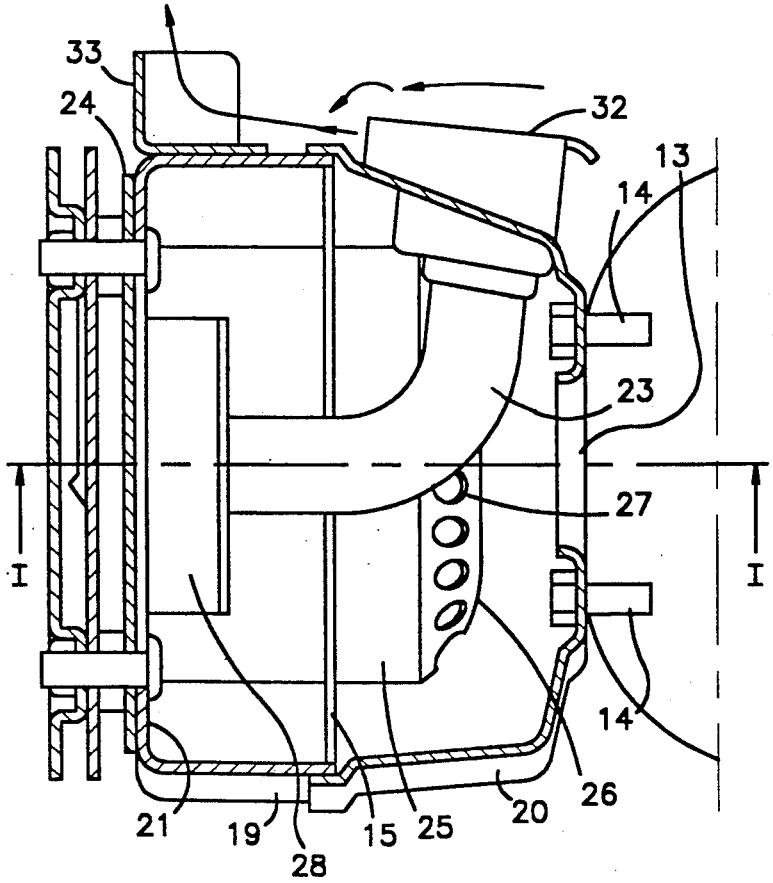

In FIG. 2 it has been indicated the possibility to mix the waste gases through the outlet with cooling air from the cooling system of the engine. Outside the outlet a guide plate 32 has been applied crosswise in the waste gas flow and along the cooling air flow. In the area after the guide plate in the cooling air flow turbulence is formed, where air and waste gases are mixed.

The mixture is deflected out of the area by means of an angle plate 33 after which the temperature in the mixture decreases to an acceptable level. The cooling air mixed to the waste gases might, in certain applications, have been subjected to filtration by which the risk of ignition of the hot waste gas flow becomes less.

The catalyst purifier now described has the property of reducing the hydrocarbon and nitric oxide content of the waste gases. A large part of the carbon mono-oxide content remains as far as this type of purification is concerned. The arrangement described can, however, be improved by means of a two-step treatment of the waste gases, where an extra catalyst is provided by feeding additional air that burns CO which has not been burned in the first step owing to lack of air. Such additional arrangements are, of course, of interest with regard to the arrangement now described which thus shall not be limited to the example given above but have the scope indicated in the following claims.

We claim:

1. An arrangement for waste gas purification of a combustion engine combined with a waste gas silencer for an engine, comprising: a catalystic element (29) placed on a partition wall (15) of the silencer, the partition wall dividing the interior of the silencer into two chambers (16, 17), characterized in that the catalytic element and surrounding plates (24, 25, 26) for guiding and distributing waste gases form a cassette in the silencer which is provided with openings (18, 22) as well as an adjoining surface (21) for forming a tight connection to the cassette, a part of the cassette forming a lid

(24) which fits over an opening (22) into the wall (21) of the silencer, the wall facing away from the engine, the inside of the lid constituting a fastening member to one end of a sheet steel cylinder (25) which projects by its free end into one of said openings (18) in said partition wall (15), the free end of the cylinder being covered by a radiation protective and distributing plate (26) provided with through passage holes.

2. An arrangement according to claim 1, characterized in that there is a cooling package outside the lid, e.g. cooling plates (30,31) parallelly arranged to the lid.

3. An arrangement according to claim 1, characterized in that the catalytic element (29) is included in the sheet steel cylinder which has a port and a collecting chamber (28) against an outlet tube (23) between the element and the lid.

4. An arrangement according to claim 1, characterized in that the outlet tube is extended through one of said chambers (17) across the partition wall (15) and out through the wall of the other chamber (16).

* * * * *